United States Patent [19]

Sietmann et al.

[11] 4,035,928

[45] July 19, 1977

[54] APPARATUS FOR DRYING GRAIN

[76] Inventors: Vernon H. Sietmann; Raymond L. Smith, both of Laurel, Iowa 50141; Larry S. Keese, Gilman, Iowa 50106

[21] Appl. No.: 597,582

[22] Filed: July 21, 1975

[51] Int. Cl.[2] ..... F26B 17/12

[52] U.S. Cl. ..... 34/174; 34/233; 34/52; 52/82; 52/192; 98/55

[58] Field of Search ..... 34/44, 52, 56, 167, 34/174, 171, 172, 233; 98/54, 55; 52/82, 192

[56] References Cited

U.S. PATENT DOCUMENTS

| | | | |
|---|---|---|---|
| 2,858,620 | 11/1958 | Naylor | 34/174 |
| 3,426,669 | 2/1969 | Peterschmidt | 98/55 |
| 3,479,748 | 11/1969 | Sietmann | 34/174 |
| 3,583,112 | 6/1971 | Kennedy | 52/82 |
| 3,849,901 | 11/1974 | Sietmann et al. | 34/52 |
| 3,908,329 | 9/1975 | Walters | 52/82 |

*Primary Examiner*—Kenneth W. Sprague
*Assistant Examiner*—James C. Yeung
*Attorney, Agent, or Firm*—Zarley, McKee, Thomte & Voorhees

[57] ABSTRACT

The invention comprises an inverted frusto-conical shaped perforated floor which is mounted in a conventional grain drying bin in a raised position relative to the base floor thereof. The perforated floor has a plurality of grain discharge openings formed therein, each of which are selectively closed by a trough-like valve. The valves have varying lengths to obtain better grain distribution on the base floor. The valves are controlled by a manually operated means. A tube tensioner is provided on the bottom surface of the perforated floor to stiffen and strengthen the perforated floor. A series of bands are mounted above the perforated floor to maintain the level of the grain being dried substantially parallel to the upper surface of the perforated floor for evenness of drying. The grain is dumped on the perforated floor and the dried air is passed upwardly through the perforated floor to dry the grain. The dried grain flows from the perforated floor through the openings onto the valve for even distribution of the base floor.

3 Claims, 5 Drawing Figures

APPARATUS FOR DRYING GRAIN

BACKGROUND OF THE INVENTION

This invention relates to an apparatus for drying grain and more particularly to an apparatus for drying grain of the continuous type.

Many attempts have been made to provide a means for satisfactorily drying grain. One method utilizes a grain drying bin, while another method utilizes a portable batch dryer. Still another method utilizes a grain drying bin which dries one batch at a time but which then requires that the batch be transferred to another bin for storage purposes. A disadvantage of the first method referred to above is primarily in subjecting several lower levels of the grain in the bin to the drying process several times. Also, in introducing the grain to be dried into this type of bin, it must be levelled by mechanical means, and in some instances stirring auger type devices are used to aid aeration of the grain. The second and third methods require additional equipment and time for handling the grain with respect to moving it from the drying equipment to the storage equipment, all of which increase the drying costs and the possible damage to the grain by over-handling.

Another method of grain drying, not as well known as the former methods, is that of batch drying grain within the upper portion of a conventional grain drying bin. This latter method uses a substantially horizontal floor with trap door or gate means formed therein, and with drying air being forced beneath the upper floor, passing therethrough to dry the grain thereabove. After drying, the grain is dumped onto the base floor of the bin for storage purposes. Disadvantages of this method are believed to include an excess of equipment such as grain leveller mounted above the upper floor for distributing grain in a level manner thereon, and the provision of a sweep auger also directly above the upper floor for aiding in the dumping of the grain after drying through the doors or gates.

Applicant's earlier apparatus for drying grain as disclosed in U.S. Pat. No. 3,501,845, represented a substantial advance in the art and the instand invention is provided to improve applicant's earlier device.

Therefore, it is a principal object of this invention to provide an improved apparatus for drying grain.

A further object of the invention is to provide an apparatus for drying grain which can be added to existing grain bins with economy.

A still further object of this invention is to provide a grain drying apparatus for use in conventional grain bins wherein storage space therein is utilized to the utmost.

A still further object of the invention is to provide an apparatus for drying grain wherein even distribution is obtained on the base floor through the use of alternative length valves.

A further object of the invention is to provide an apparatus for drying grain including a series of bands designed to achieve a more uniform grain distribution on the perforated floor of the apparatus.

A further object of the invention is to provide an apparatus for drying grain including a perforated floor having means associated therewith for stiffening and strengthening the same.

A still further object of the invention is to provide an apparatus for drying grain included a ribbed perforated floor designed to proportionately divide the drying grain on the perforated floor.

A still further object of the invention is to provide an apparatus for drying grain which is economical of manufacture, efficient in operation and durable in use.

These and other objects will be apparent to those skilled in the art.

BRIEF DESCRIPTION OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings, in which:

DESCRIPTION OF THE PREFERRED EMBODIMENT

Figure 1:
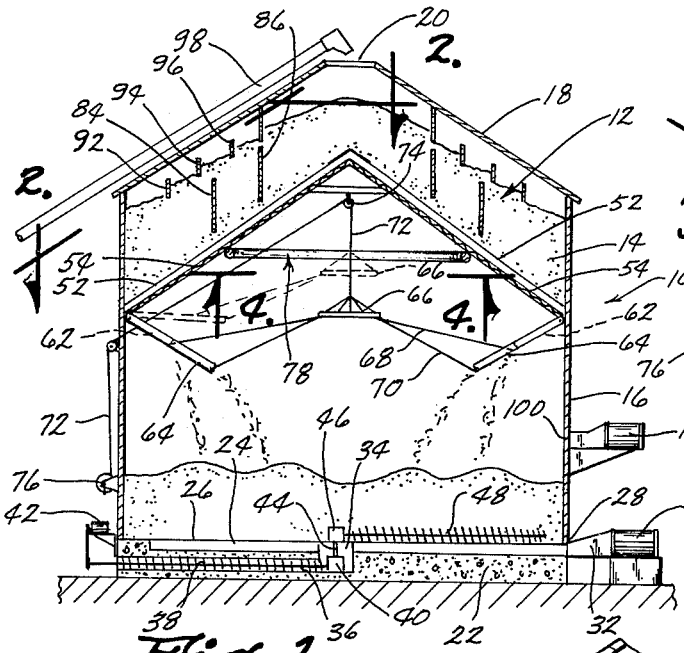
FIG. 1 is a vertical cross-sectional view of the grain drying apparatus of this invention shown and installed in assembled relationship with the grain bin.

The numeral 10 generally designates a conventional grain bin which houses the grain drying apparatus indicated generally at 12 which is capable of drying granular material 14 for subsequent storage in the lower part of the bin 10. The grain bin 10 comprises a side wall 16 and a conical shaped roof 18 mounted thereon. An opening 20 is formed in the apex of the roof 18, and therebelow is found a foundation or base floor 22. Base floor 22 has an X-shaped trough 24 formed therein, and spaced above the surface of the base floor 22 is a perforated plate 26 capable of holding granular material while enabling air from therebelow to pass upwardly therethrough.

One leg of the trough 24 communicates to the exterior of the bin 10 through a passage 28 formed on the side wall 16. A blower system 30 communicates with the trough 24 through duct 32, and upon energizing the blower 30, air is forced into the trough 24 whereupon it circulates upwardly through the perforated floor plate 26 and through granular materials stored thereon for aeration purposes.

At the center of the floor 22, a sump opening 34 is formed therein which communicates with a tunnel 36 formed in the floor 22. The tunnel 36 leads from the sump opening 34 to the outside of the bin 10. An auger 38 is axially mounted in the tunnel 36, with one end secured to a gear housing 40 mounted in the base of the sump opening 34. The other end of the auger 38 is connected to a motor 42 for rotating the same.

The gear housing 40 has a vertically disposed shaft 44 rotatably mounted therein which extends upwardly therefrom. Secured to the upper part of the shaft 44 is a second gear housing 46. A sweep auger 48 is rotatably attached to the gear housing 46 and is operated thereby. The motor 42 is operable to rotate the auger 38 which in turn causes the sweep auger 48 to rotate about its horizontal axis and to rotate about the shaft 44.

Figure 2:
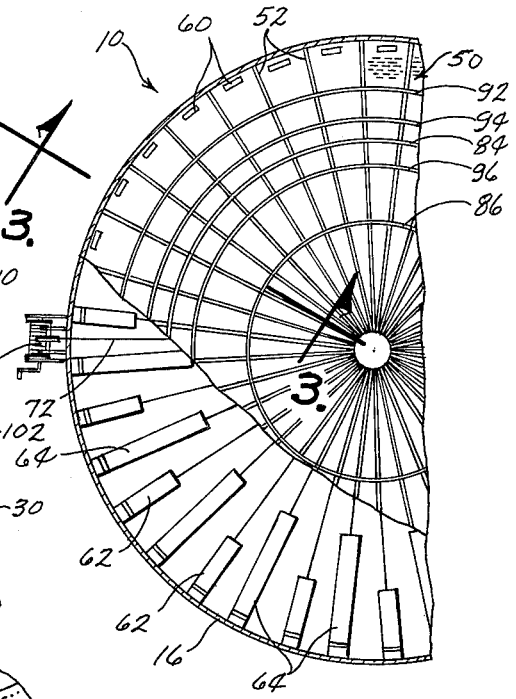
FIG. 2 is a fragmentary sectional view seen on lines 2 — 2 of FIG. 1.
Figure 5:
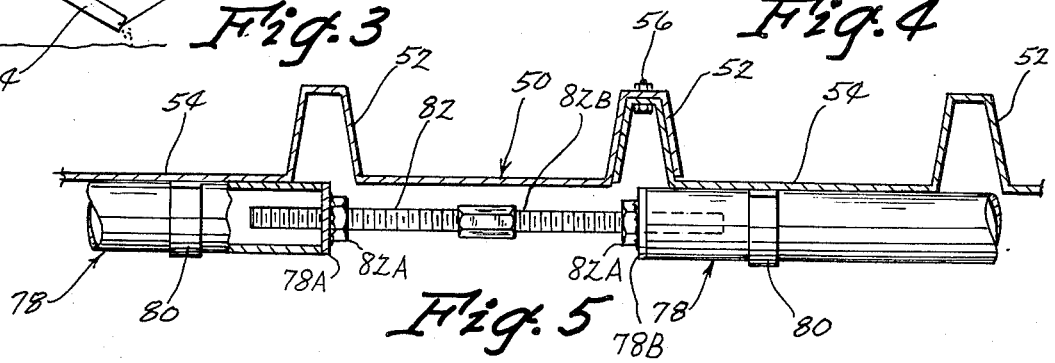
FIG. 5 is an enlarged sectional view seen on lines 5 — 5 of FIG. 3.

Drying apparatus 12 generally comprises an inverted-frusto-conical shaped perforated floor 50 having a plurality of spaced apart ribs 52 which extend radially outwardly from the center to the periphery thereof. The floor 50 is formed of a plurality of floor sections 54 which are secured together by bolts 56 as illustrated in FIG. 5. A lower edge 58 of floor 50 is secured to the wall 16 by any convenient means and has a plurality of spaced apart openings 60 formed therein which are positioned between the ribs 52. Trough-like valves 62 and 64 are pivotally secured to the lower edge of the floor 50 beneath the openings 60 in an alternate fashion as illustrated in FIG. 2. As seen in FIG. 2, valves 64 have a greater length than the valve 62 so that a more even grain flow is achieved on the base floor as illustrated in FIG. 1. The valves 62 and 64 are connected to a central support 66 by means of a plurality of cables 68 and 70 respectively. Central support 60 has a cable 72 extending upwardly therefrom which passes over a pulley 74 secured to the floor 50. Cable 72 extends outwardly through side wall 16 as illustrated in FIG. 1 and has a hand-operated winch or crank mechanism connected thereto referred to generally by the reference numeral 76. Thus, operation of the mechanism 76 causes the valves 62 and 64 to be pivoted relative to the floor 50.

Figure 4:
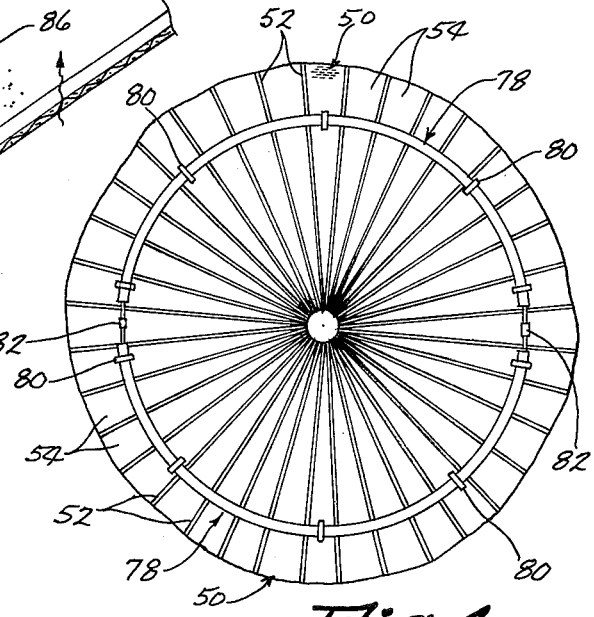
FIG. 4 is an enlarged sectional view seen on lines 4 — 4 of FIG. 1.

The numeral 78 refers generally to a stiffening or strengthening tube means which is secured to the underside of floor 50 by a plurality of U-shaped clips or brackets 80. Stiffening tubes 78 are ring-shaped as illustrated in FIG. 4 and has a pair of turnbuckles 82 disposed between the opposed ends 78A and 78B of tubes 78 as illustrated in FIGS. 4 and 5. Turnbuckles 82 are comprised of internally threaded nuts 82A which are welded to tube ends 78A and 78B. Threaded turnbuckle shaft 82B is threadably received in nuts 82A. Rotation of shaft 82B will either draw the ends 78A and 78B together or move them apart, depending on the direction of rotation. When the floor 50 is mounted in the bin 10, the turnbuckles 82 are operated to place the floor 50 in compression to stiffen the floor to eliminate the need for vertical support at the center of the floor 50. In other words, the effect of length of tube 78 is increased relative to the floor 50 which causes the floor 50 to slightly "bow" upwardly and to be placed in compression to stiffen the same.

Figure 3:
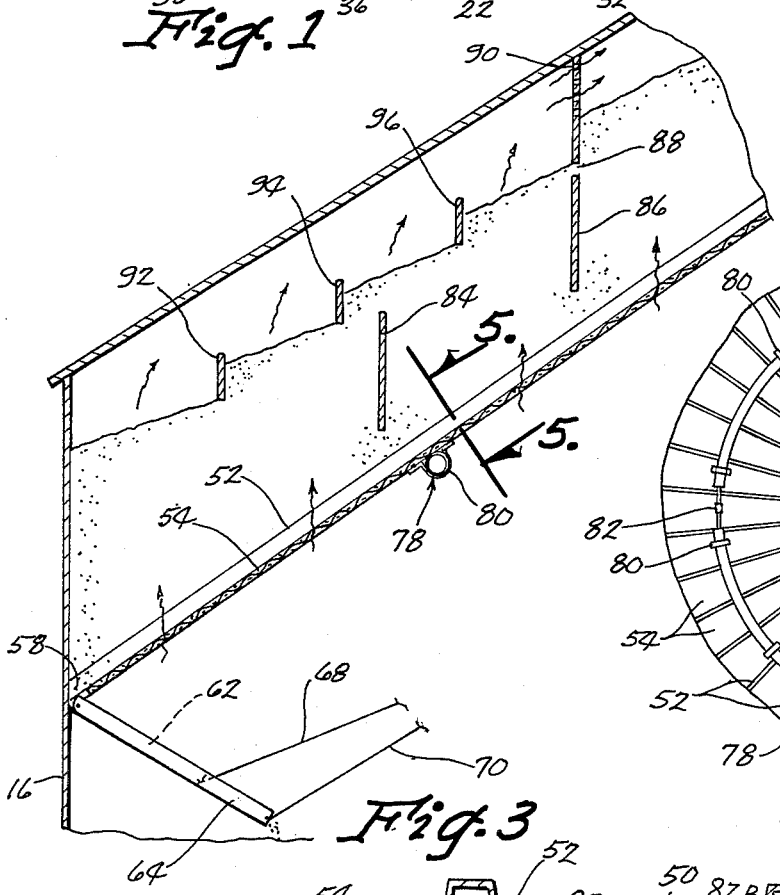
FIG. 3 is an enlarged sectional view seen on lines 3 — 3 of FIG. 2.

The numerals 84 and 86 refer to a pair of concentric bands which are secured within the bin 10 by any convenient means so that they are disposed in the manner illustrated in FIG. 3. As seen in FIG. 3, the lower ends of the bands 84 and 86 are spaced above the upper surface of the floor 50 to permit grain to flow therebetween. Band 86 is provided with an opening 88 formed therein which determines the depth of the grain on the floor 50. Preferably, opening 88 has a vertical heigth of approximately two inches. Preferably, the lower end of band 86 is spaced approximately six inches above the floor 50 to permit the hot grain on the floor 50 moving. A plurality of openings 90 are provided in the upper end of band 86 to permit air flow as illustrated by the arrows in FIG. 3.

The numerals 92, 94 and 96 refer to concentric bands secured within the bin 10 above the floor 50 by any convenient means and positioned as illustrated in FIG. 3 to aid in maintaining the grain in a substantially parallel relationship with respect to the floor 50.

Operation of the drying apparatus 12 as illustrated in the drawings is as follows. With all of the valves 62 and 64 closed, and with the bands 84, 86, 92, 94 and 96 so mounted so as to receive a full batch of grain, the grain is dumped through the opening 20 by the grain auger 98. The grain falls downwardly on the floor 50 in all radial directions until it reaches the juncture of the floor 50 and the side wall 16 at which time it begins to fill up that portion of the grain bin 10 above the floor 50. The filling process continues until the grain reaches the level illustrated in FIG. 3. Thus, upon the entry of drying air through the opening 100 by the drying apparatus 102, the air passes upwardly through the perforated floor 50 for drying the grain held thereabove. The moist air is permitted to escape upwardly from the bin through the opening 20 as illustrated in the drawings. After sufficient drying has occurred, the mechanism 76 would be operated so as to lower the valves 62 and 64 to the position illustrated in FIG. 1 so that the dried grain can pass downwardly through the openings 60 and onto the valves for deposit onto the floor 24 as illustrated in FIG. 1. The alternate lengths of the valves 62 and 64 cause the grain to be deposited in a more even manner on the floor 22 than if all of the valves have the same length.

The bands 84, 86, 92, 94 and 96 insure that the grain will be more evenly held on the perforated floor 50 so as to be substantially parallel thereto thereby resulting in a more even grain drying. The ribs 52 on the floor 50 tend to proportionately divide the grain so that a more even flow is achieved through all of the openings 60. As previously described, the stiffening or strengthening tubes 78 causes the floor 50 to be placed in compression to be able to support the weight of the grain therein without providing additional support for the floor other than at the lower edge thereof. The elimination of a central support for the floor 50 results in a more even grain flow thereabove.

Aeration for the stored grain is provided by energizing the blower 30 for forcing cool air through the duct 32. The cool air, as it passes upwardly through the stored grain will absorb heat therefrom and will carry it upwardly. Advantageously, the cool air, now heated, passes through the perforated floor 50 and augments the heat air supplied by the blower system 102.

To evacuate the grain from the lower floor 22, the sweep auger is operated to move the grain into the sump opening 34. The motor 42 is then energized and the grain is carried outwardly of the grain bin 10.

It should be noted that the dryer is of the "batch" type as opposed to a "continuous" type. After one batch has been dried and deposited on floor 22, the valves 62 and 64 are closed and a new batch of material is dumped or deposited on the floor 50.

Thus it can be seen that the drying apparatus of this invention accomplishes at least all of its stated objectives.

We claim:

1. An apparatus for drying granular material in a grain bin having an enclosure forming wall, a roof mounted over the wall, and a base floor for the wall, the apparatus comprising:

a perforated floor mounted in the upper part of the bin, said floor being inclined and sloping downwardly from the center of the bin toward and in contacting relation with the wall whereby granular material disposed on said floor is prevented from falling onto said base floor, said floor having a plurality of spaced apart openings formed therein adjacent the lower end thereof through which the granular material can fall, said perforated floor being free from support except at said wall, closure means operatively mounted in said bin for selectively closing said openings to vary the rate of flow of the granular material therethrough, and means for supplying drying air within the bin and below said floor, said perforated floor having a plurality of spaced apart radially extending upstanding ribs formed therein.

2. An apparatus for drying granular material in a grain bin having an enclosure forming wall, a roof mounted over the wall, and a base floor for the wall, the apparatus comprising:

a perforated floor mounted in the upper part of the bin, said floor being inclined and sloping downwardly from the center of the bin toward and in contacting relation with the wall whereby granular material disposed on said floor is prevented from falling onto said base floor, said floor having a plurality of spaced apart openings formed therein adjacent the lower end thereof through which the granular material can fall, said perforated floor being free from support except at said wall, closure means operatively mounted in said bin for selectively closing said openings to vary the rate of flow of the granular material therethrough, and means for supplying drying air within the bin and below said floor, said closure means comprising a plurality of first and second valve members disposed in an alternate relationship below said openings, said first valve members having greater length than said second valve members.

3. A rigid inclined load bearing floor, comprising, a circular support wall, a conically-shaped floor mounted at its lower periphery to said wall and extending upwardly in an inclined direction therefrom, a horizontally disposed circular stiffening tube means having spaced opposite ends rigidly secured to the underside of said floor in spaced relation to said wall, and means for adjusting the length of said stiffening tube means to exert stress on said floor to place said floor in compression and to thereby increase the load bearing characteristics thereof; said means comprising a turnbuckle having internally threaded elements rigidly secured to the opposite ends of said tube means, and a threaded turnbuckle shaft extending through said internally threaded elements whereby rotation of said turnbuckle shaft in one direction will draw the opposite ends of said tube means together, and rotation of said turnbuckle shaft in an opposite direction will move said opposed ends apart.

* * * * *